US007425116B2

(12) United States Patent
Chang

(10) Patent No.: US 7,425,116 B2
(45) Date of Patent: Sep. 16, 2008

(54) VANE CONDUCTING DEVICE WITH GRAPHIC AND TEXTUAL DISPLAY

(76) Inventor: Chih-Chang Chang, 1F., No. 17, Alley 10, Lane 483, Cingyun Rd., Tucheng City, Taipei County 236 (TW)

( * ) Notice: Subject to any disclaimer, the term of this patent is extended or adjusted under 35 U.S.C. 154(b) by 292 days.

(21) Appl. No.: 11/399,332

(22) Filed: Apr. 7, 2006

(65) Prior Publication Data

US 2007/0041828 A1 Feb. 22, 2007

(30) Foreign Application Priority Data

Aug. 19, 2005 (TW) ..... 94214238 U

(51) Int. Cl.
*F04D 29/00* (2006.01)

(52) U.S. Cl. ..... 416/5

(58) Field of Classification Search ..... 416/5
See application file for complete search history.

(56) References Cited

U.S. PATENT DOCUMENTS 7,332,841 B2 * 2/2008 Hsu ..... 416/5
2003/0049124 A1 * 3/2003 Liu ..... 416/5

* cited by examiner

*Primary Examiner*—Richard Edgar

(57) ABSTRACT

A vane conducting device with graphic and textual display includes a base, a coil seat, a vane, and a control unit, and a support pillar of the base includes a first electrode and a second electrode electrically coupled to a first bearing and a second bearing respectively, and a circuit board of the coil seat is electrically coupled to an end of the first and second electrodes for transmitting electric power to the first and second bearings through the first and second electrodes, and a cap of the vane includes a central shaft pivotally coupled to the first and second bearings, such that when the vane rotates, the first and second bearings and the central shaft transmit the electric power required by the control unit through the first and second electrodes.

10 Claims, 6 Drawing Sheets

VANE CONDUCTING DEVICE WITH GRAPHIC AND TEXTUAL DISPLAY

BACKGROUND OF THE INVENTION

1. Field of the Invention

The present invention relates to a heat dissipating fan conducting device that emits light to display graphics and texts, and more particularly to a power transmission through a central shaft of a vane of a heat dissipating fan to supply the electric power required by a control circuit installed on the vane of the heat dissipating fan.

2. Description of Prior Art

In the present heat dissipating fans used in electronic equipments for dissipating heat produced by electronic components or discharging heat from a housing of electronic components to assure the normal operation of the electronic components.

In general, the present or past heat dissipating fan structures usually include a fan base, a coil seat installed at the center of the fan base, and a vane pivotally coupled to the coil seat. If the coil seat is electrically connected, a magnetic field will be produced by the coil seat to drive a magnetic element in the vane to rotate the vane. Since the heat dissipating fan simply plays the role of dissipating heat, the fan has no other functions in this technical area.

Based on the consideration of looking for innovative changes to attract young consumers, present electronic equipments emphasize on fascinating stylish designs, and thus even the dull traditional heat dissipating fan becomes an object for improvements. There are different kinds of heat dissipating fans having a light emitting device, such as the ones with a light source installed at the back of the vane. If the vane rotates, the light source will produce a blinking effect when the light is blocked by the rotating blades. Some designs install light emitting elements at the periphery of the base of the heat dissipating fan, and the light emitting elements produce a dazzling visual effect from a light source projected by the rotating vane. Some manufacturers combine a plurality of light emitting elements into a flexible circuit board and use a timing control circuit to control or light up each light emitting element. If the vane rotates, the expected graphics or texts can be produced on the vane by the principle of human visual persistence.

Since the foregoing light emitting elements are installed at the back of the vane or on the fan base, the electrodes can be hidden appropriately to maintain an overall aesthetic appearance of the heat dissipating fan. If the light emitting elements are installed at the front of the vane, the electrodes will be connected to the front of the vane, and such arrangement not only ruins the overall aesthetic appearance of the heat dissipating fan, but the exposed electrodes also interferes the normal operation of the vane.

SUMMARY OF THE INVENTION

In view of the foregoing shortcomings of the prior art, the inventor of the present invention based on years of experience in the related industry to conduct experiments and modifications, and finally designed a vane conducting device with graphic and textual display to overcome the shortcomings of the prior art structure.

The present invention is to overcome the shortcomings of the prior art and avoid the existing deficiencies by providing a new design of power transmission, without ruining the overall aesthetic appearance of a heat dissipating fan or interfering the normal operation of its vanes.

The heat dissipating fan conducting device that emits light to display graphics comprises:

a base, having a hollow support pillar, and the support pillar including a first electrode and a second electrode and a first bearing and a second bearing electrically coupled to the first and second electrodes;

a coil seat, having a printed circuit board electrically coupled to an end of the first and second electrodes and transmitting electric power to the first and second bearings through the first and second electrodes;

a vane, having a cap, and the cap including a central shaft therein, and the central shaft comprising an axle rod and an axle pipe, and a gap formed between the axle rod and the axle pipe, and the axle pipe being coupled to the first bearing and the axle rod being coupled to the second bearing; and a control unit, electrically coupled to a first circuit board and a second circuit board, and the second circuit board including a plurality of light emitting elements controlled by the first circuit board.

BRIEF DESCRIPTION OF DRAWINGS

The features of the invention believed to be novel are set forth with particularity in the appended claims. The invention itself however may be best understood by reference to the following detailed description of the invention, which describes certain exemplary embodiments of the invention, taken in conjunction with the accompanying drawings in which:

DETAILED DESCRIPTION OF THE INVENTION

The technical characteristics, features and advantages of the present invention will become apparent in the following detailed description of the preferred embodiments with reference to the accompanying drawings.

Figure 1:
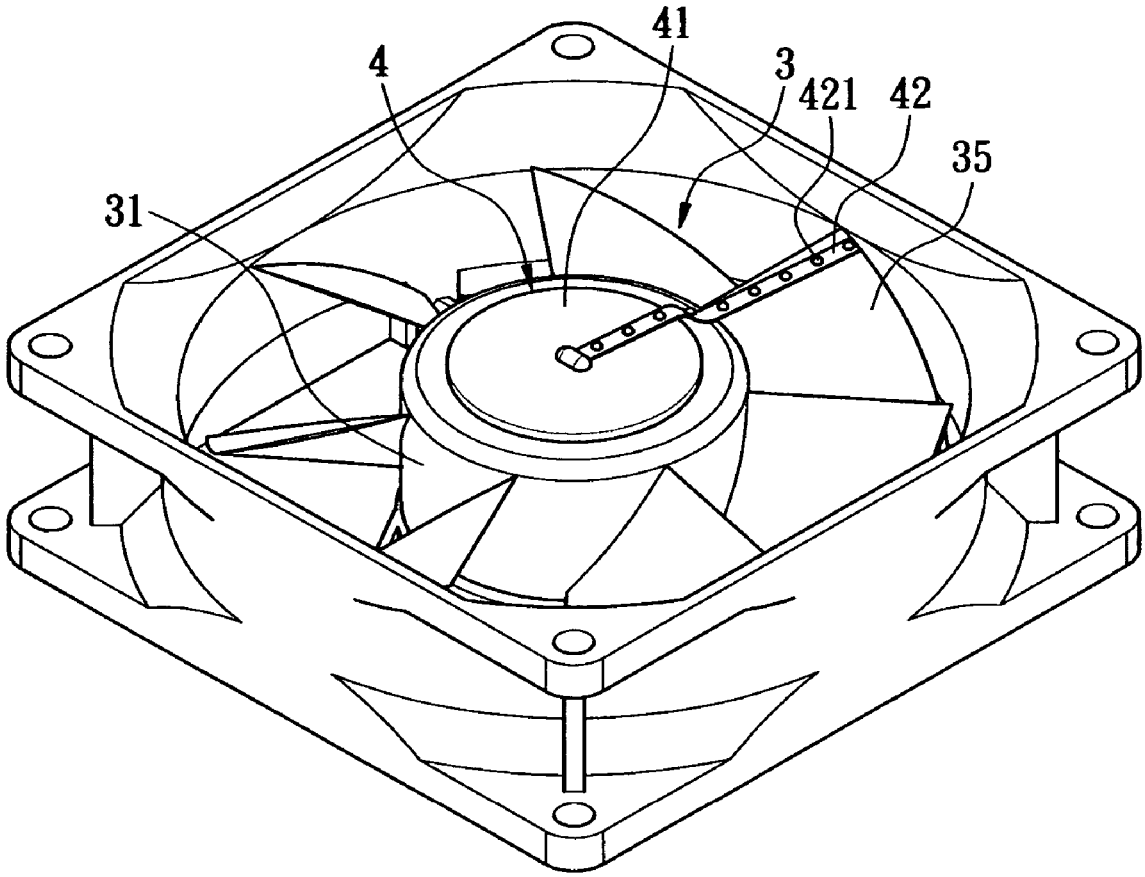
FIG. 1 is a perspective view of a heat dissipating fan of the present invention.
Figure 2:
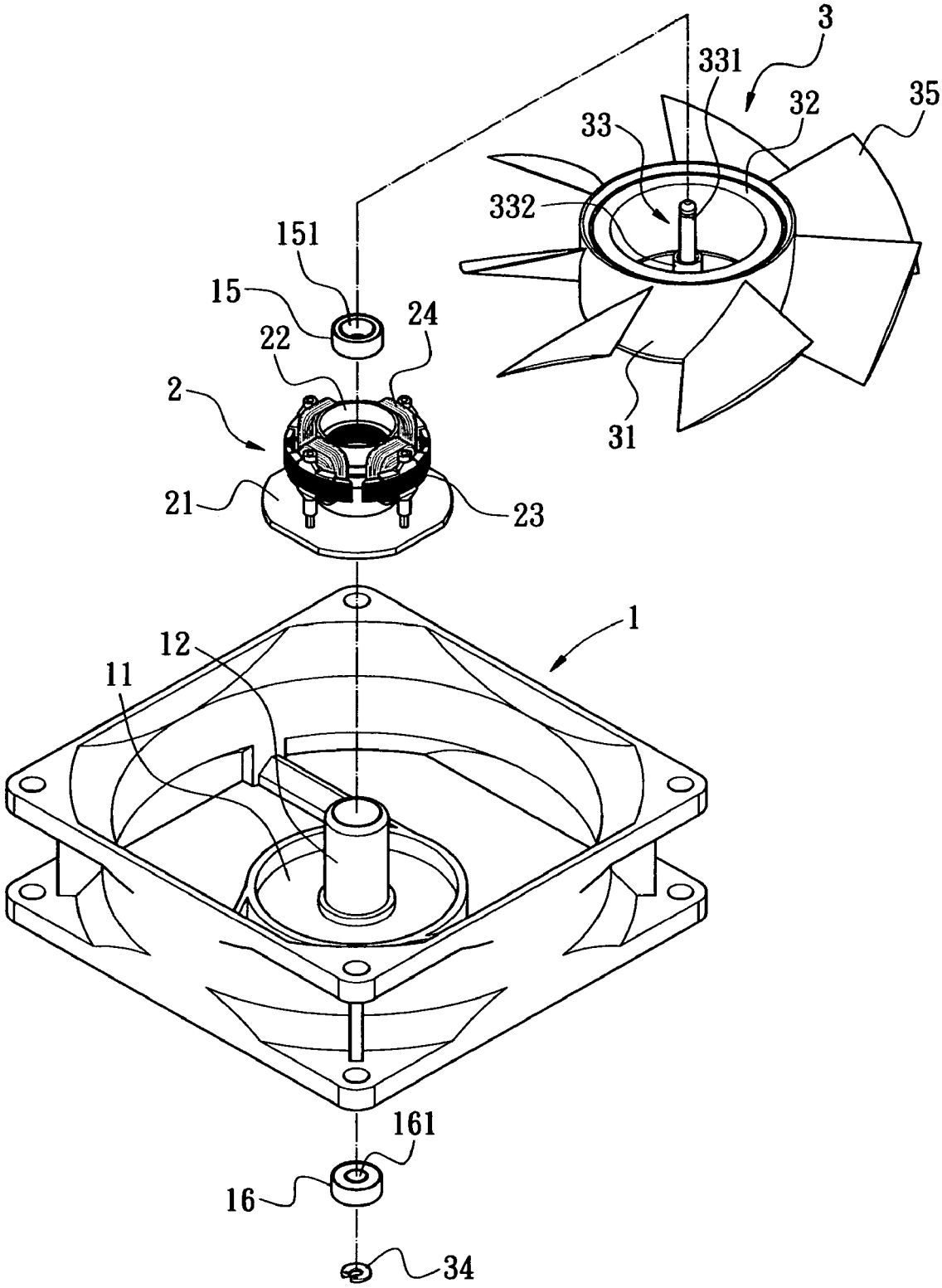
FIG. 2 is an exploded view of FIG. 1.
Figure 3:
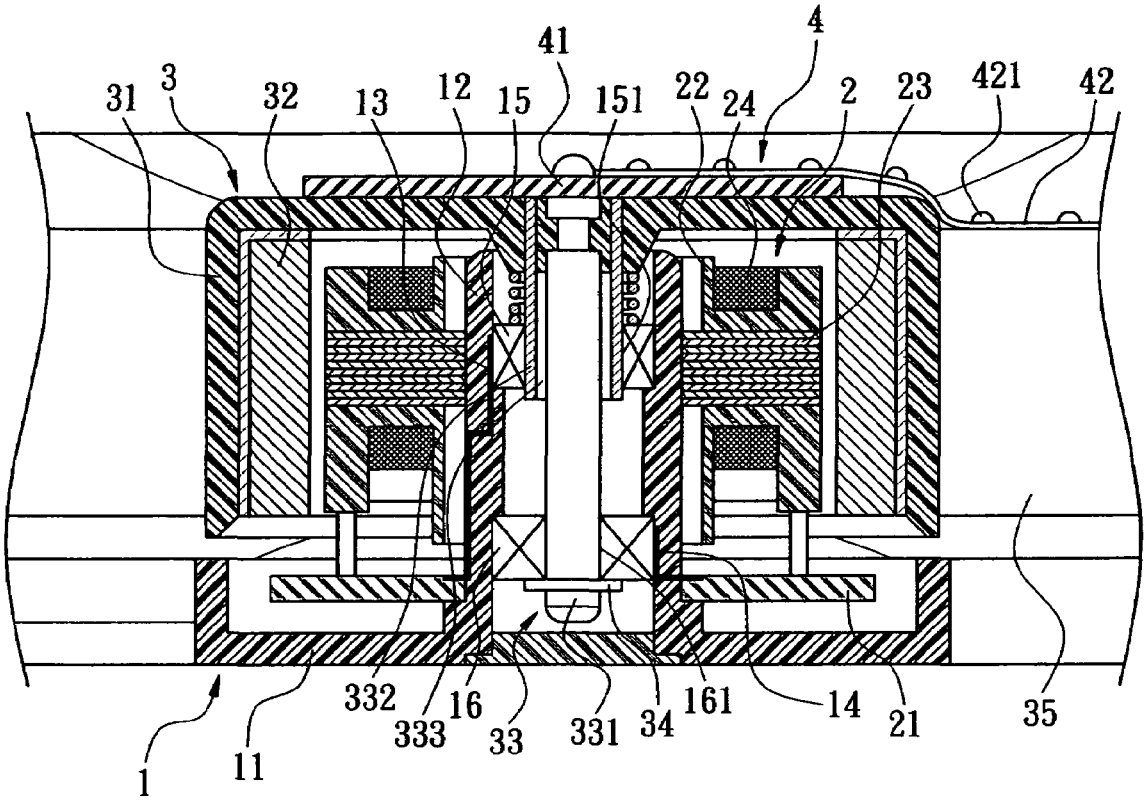
FIG. 3 is a cross-sectional view of FIG. 1.

Referring to FIGS. 1 to 3 for the perspective view, the exploded view, and the cross-sectional view of a heat dissipating fan in accordance with the present invention, a vane conducting device with graphic and textual display comprises a base 1, a coil seat 2 installed on the base 1, a vane 3 pivotally coupled to the coil seat 2, and a control unit 4 installed on the vane 3. A central shaft 33 of the vane 3 is used for transmitting electric power to the control unit 4, so that after the light emitting elements 421 of the control unit 4 are lit, various different textual or graphic changes produced by the lit light emitting elements 421 can be viewed by our visual persistence.

The base 1 includes a bottom portion 11, and the bottom portion 11 includes a hollow support pillar 12 at its center, and the support pillar 12 includes a first electrode 13 and a second electrode 14 disposed on the anode and cathode of a power supply, and the support pillar 12 contains a first bearing 15 and a second bearing 16 electrically coupled to the first electrode 13 and the second electrode 14, and through holes 151, 161 of the first bearing 15 and the second bearing 16 have unequal diameters.

The coil seat 2 is installed on the support pillar 12 and includes a rigid circuit board 21 thereon, and the circuit board 21 installs a hollow pillar 22, and the hollow pillar 22 includes a set of silicon steel plate 23 sheathed thereon, and the silicon steel plate 23 is wound with a coil 24, and both ends of the coil 24 are electrically coupled to the circuit board 21, and the coil seat 2 is disposed on the base 1, and the circuit board 21 is electrically coupled to an end of the first electrode 13 and the second electrode 14. If the power is supplied to the circuit board 21, the coil 24 will produce a magnetic field, and the first electrode 13 and the second electrode 14 will transmit the electric power to the first bearing 15 and the second bearing 16.

The vane 3 includes a cap 31, and the cap 31 carries a plurality of blades 35 at the exterior of the cap 31, and a magnetic element 32 comprised of a magnet is installed onto the internal wall of the cap 31, and the cap 31 includes a central shaft 33 disposed at the center of the cap 31. The central shaft 33 includes an axle rod 331 and an axle pipe 332, and a separating gap 333 is formed between the axle rod 331 and the axle pipe 332, such that when the central shaft 33 is pivotally coupled to the first and second bearings 15, 16, the axle pipe 332 will be connected to a through hole 151 of the first bearing 15, and the axle rod 331 will be pivotally coupled to a through hole 161 of the second bearing 16, and then a latching ring 34 latches an end of the axle rod 331 to prevent the vane 3 from being loosened or falling out due to its rotation.

The control unit 4 is installed on the vane 3 and includes a first circuit board 41 and a second circuit board 42 which are made of a flexible thin film material. The first circuit board 41 includes a control circuit (which will be described in details later), and the second circuit board 42 includes a plurality of light emitting elements 421 which are light emitting diodes.

After an external power supply is transmitted to the circuit board 21 of the coil seat 2, the electric power is supplied to the coil 24 to produce a magnetic field and drive the vane 3 to rotate, while the power is transmitted to the first and second electrodes 13, 14, and passed through the first and second bearings 15, 16 to the axle pipe 332 and the axle rod 331 to provide the power required by the first circuit board 41 and the second circuit board 42 of the vane 3. By then, the control circuit on the first circuit board 41 can control a light emitting element 421 of the second circuit board 42 to be lit with a different brightness. With our visual persistence, we can see various different textual and graphic changes of the lit light emitting elements 421.

Figure 4:
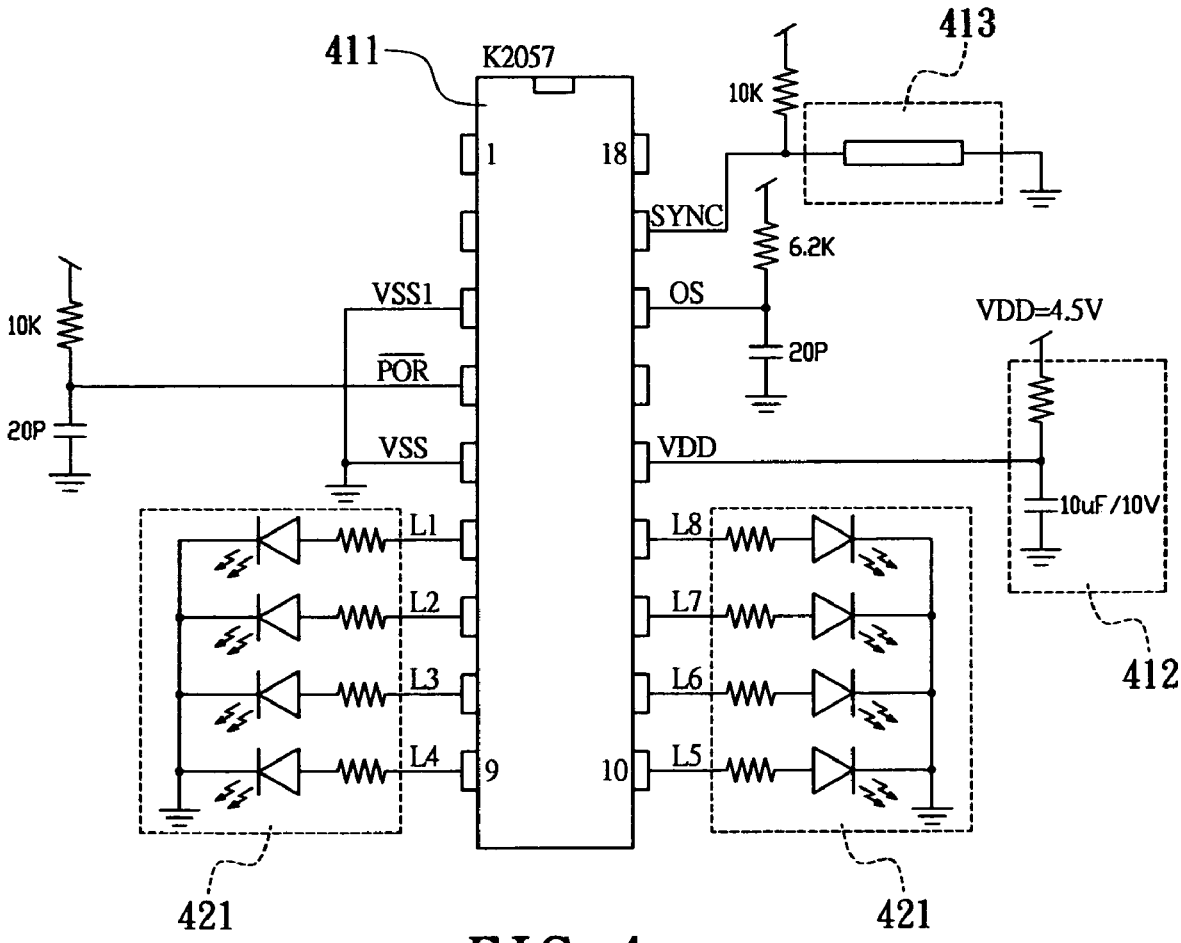
FIG. 4 is a schematic circuit diagram of a control circuit of a control unit of the present invention.

Referring to FIG. 4 for the schematic circuit diagram of a control circuit of a control unit of the present invention, the control circuit comprises a microprocessor 411, a storage element 412 for supplying electric power to the microprocessor 411, a sensing element 413 for providing a detected signal to the microprocessor 411, and a plurality of light emitting elements 421 driven by the microprocessor 411.

The microprocessor 411 stores a control program for controlling the light emitting elements 421 to produce various textual and graphic changes with a different brightness.

The storage element 412 is comprised of a capacitor for storing the electric power transmitted from the central shaft 33 of the vane 3.

The sensing element 413 is comprised of any one of a Hall IC or a reed switch for detecting the initial position of the vane 3 and driving the light emitting elements 421 to produce various different textual and graphic changes, while displaying the texts and graphics at a fixed position, so that the textual and graphic changes will not be moved according to the rotation of the vane 3, but will produce a change of the displaying position.

The light emitting element 421 is a light emitting diode controlled by an output signal of the microprocessor 411 to produce various textual and graphic changes with a different brightness.

After the central shaft 33 of the vane 3 transmits the electric power to the control circuit, the electric power is stored in the storage element 412, and the storage element 412 supplies the electric power required by the control circuit. By then, the microprocessor 411 controls the light emitting elements 421 according to a program design to produce changes of different brightness. With our visual persistence, we can see various textual and graphic changes of the lit light emitting elements 421.

Since the central shaft 33 of the vane 3 usually operates with the first and second bearings 15, 16 for a long time, the central shaft 33 and the first and second bearings 15, 16 will produce a gap due to factors such as centrifugal force and friction, and thus causing the central shaft 33 and the first and second bearings 15, 16 to shake or resulting a poor contact. Thus, the electric power cannot be transmitted to the first circuit board 41 in a short time. After the electric power transmitted by the central shaft 33 is supplied to the first circuit board 41, the electric power is stored in the storage element 412, and then the storage element 412 releases the electric power slowly. Even if there is a gap formed between the central shaft 33 and the first and second bearings 15, 16 to produce vibrations, a poor contact will not occur, so as to assure a normal power supply.

Figure 5:
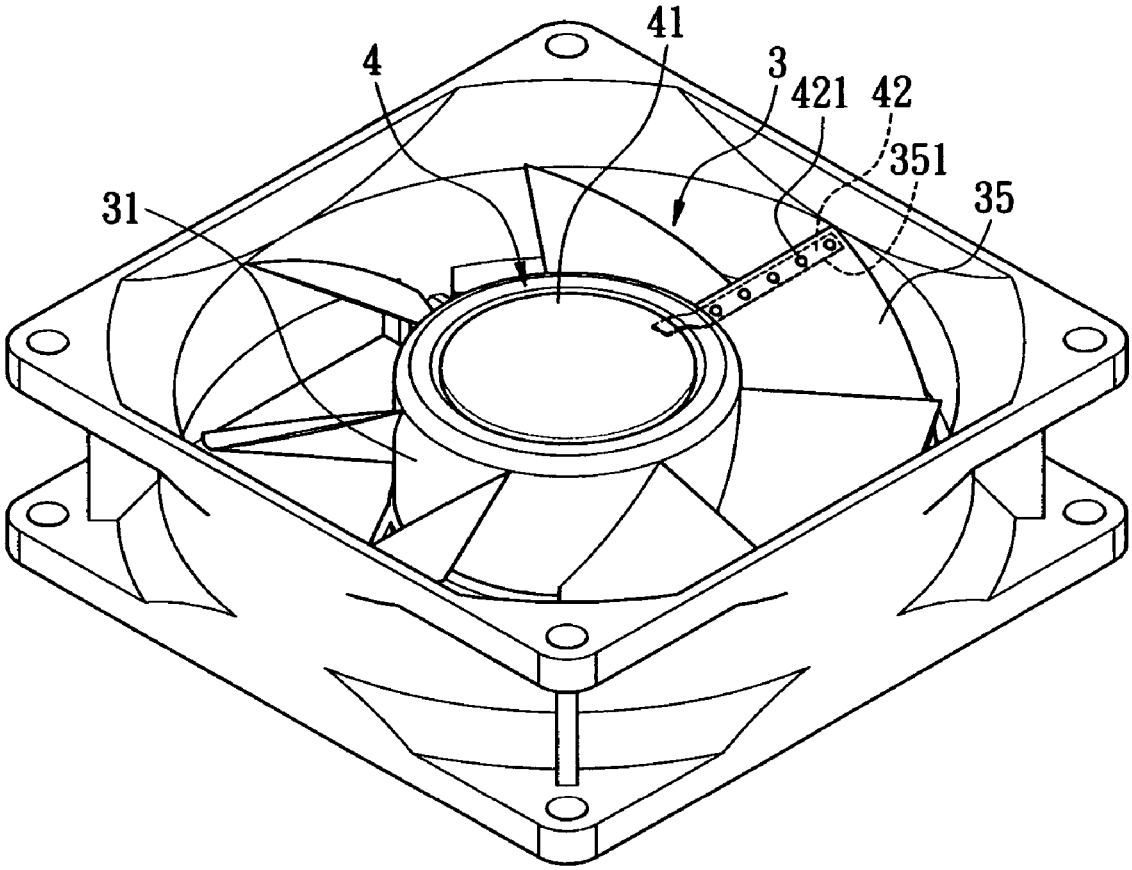
FIG. 5 is a schematic view of another preferred embodiment of the present invention.

Referring to FIG. 5 for the schematic view of another preferred embodiment of the present invention, the blade 35 on the vane 3 includes a recession 351, and the recession 351 can be connected or embedded into a second circuit board 42 which is made of a flexible thin film material. If the vane 3 rotates, various different textual and graphic changes can be seen on each blade 35.

Figure 6:
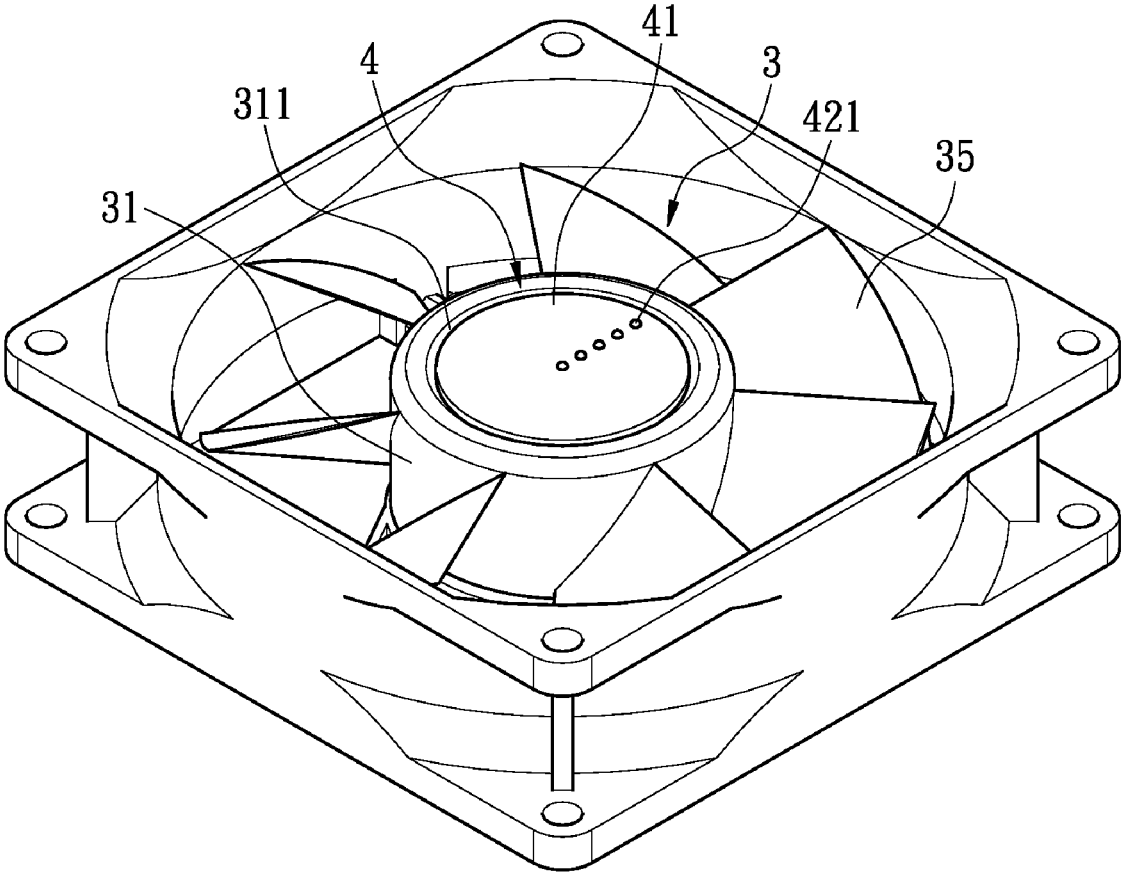
FIG. 6 is a schematic view of a further preferred embodiment of the present invention.

Referring to FIG. 6 for the schematic view of a further preferred embodiment of the present invention, the cap 31 of the vane 3 includes a recession 311 disposed at the surface of the cap 31, and the recession 311 can be connected or embedded into a second circuit board 42 which is made of any one of a flexible or a rigid thin film material. In the meantime, the second circuit board 42 includes a plurality of light emitting elements 421. If the vane 3 rotates, various textual and graphic changes on the surface of the cap 31 of the vane 3 can be seen.

The present invention are illustrated with reference to the preferred embodiment and not intended to limit the patent scope of the present invention. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A vane conducting device with graphic and textual display, comprising:

a base, having a bottom portion, a hollow support pillar disposed at the central position of the bottom portion, a first electrode and a second electrode disposed on the support pillar, and a first bearing and a second bearing installed in the support pillar and electrically coupled to the first and second electrodes respectively;

a coil seat, installed on the support pillar and having a main circuit board, and the main circuit board being electrically coupled to an end of the first and second electrodes for transmitting electric power to the first and second bearings through the first and second electrodes;

a control unit having a first circuit board on the cap and a second circuit board on the first circuit board, and the second circuit board including a plurality of light emitting elements controlled by the first circuit board; and a vane, having a cap, and a central shaft disposed at a central position of the cap, and the central shaft including an axle rod and an axle pipe, and a separating gap being formed between the axle rod and the axle pipe, an end of the axle pipe being pivotally received in the first bearing, the other end of the axle pipe directly contacting the first circuit board attached on the cap for forming a directly electric connection between the first bearing and the first circuit board, and the axle rod being pivotally coupled to the second bearing.

2. The vane conducting device with graphic and textual display of claim 1, wherein the first and second bearings have a through hole respectively, which have unequal diameters.

3. The vane conducting device with graphic and textual display of claim 1, wherein the main circuit board of the coil seat is made of a rigid material.

4. The vane conducting device with graphic and textual display of claim 1, wherein the main circuit board includes a hollow cylinder, and the hollow cylinder includes a silicon steel plate thereon and a coil wound around the silicon steel plate, and both ends of the coil are separately and electrically coupled to the main circuit board.

5. The vane conducting device with graphic and textual display of claim 1, wherein the cap carries a plurality of blade at the exterior of the cap and a magnetic element disposed on an internal wall of the cap.

6. The vane conducting device with graphic and textual display of claim 5, wherein the magnetic element is a magnet.

7. The vane conducting device with graphic and textual display of claim 1, wherein the axle rod has its end latched to a latching ring.

8. The vane conducting device with graphic and textual display of claim 1, wherein the first and second circuit boards are made of any one of a flexible thin film material or a rigid material.

9. The vane conducting device with graphic and textual display of claim 1, wherein the first circuit board includes a control circuit for controlling the light emitting elements to produce various textual and graphic changes.

10. The vane conducting device with graphic and textual display of claim 1, wherein the light emitting element is a light emitting diode.

* * * * *